US008490705B2

(12) United States Patent
Curtiss, III

(10) Patent No.: US 8,490,705 B2
(45) Date of Patent: Jul. 23, 2013

(54) HYDRAULIC CONTROL SYSTEM MONITORING APPARATUS AND METHOD

(75) Inventor: Jason Post Curtiss, III, Houston, TX (US)

(73) Assignee: Diamond Offshore Drilling, Inc., Houston, TX (US)

( * ) Notice: Subject to any disclaimer, the term of this patent is extended or adjusted under 35 U.S.C. 154(b) by 283 days.

(21) Appl. No.: 12/913,452

(22) Filed: Oct. 27, 2010

(65) Prior Publication Data

US 2011/0098946 A1 Apr. 28, 2011

Related U.S. Application Data

(60) Provisional application No. 61/255,745, filed on Oct. 28, 2009.

(51) Int. Cl.
*E21B 34/04* (2006.01)
*E21B 47/00* (2012.01)

(52) U.S. Cl.
USPC ..... 166/368; 166/344; 166/363; 166/250.1; 166/373; 251/1.1; 702/50

(58) Field of Classification Search
USPC ..... 166/368, 344, 351, 363, 250.01, 166/373, 386; 137/315.02; 251/1.1–1.3; 702/50
See application file for complete search history.

(56) References Cited

U.S. PATENT DOCUMENTS 4,384,612 A * 5/1983 Bradford et al. ..... 166/66
4,880,060 A * 11/1989 Schwendemann et al. ... 166/336
4,923,008 A * 5/1990 Wachowicz et al. ..... 166/373
6,484,806 B2 * 11/2002 Childers et al. ..... 166/351
6,655,405 B2 * 12/2003 Hollister et al. ..... 137/102
6,779,543 B2 * 8/2004 Hollister et al. ..... 137/102
7,367,393 B2 * 5/2008 Vachon ..... 166/250.01
7,539,548 B2 * 5/2009 Dhawan ..... 700/19
7,706,980 B2 * 4/2010 Winters et al. ..... 702/9
7,757,772 B2 * 7/2010 Donohue et al. ..... 166/344
7,967,066 B2 * 6/2011 McStay et al. ..... 166/250.01
8,020,623 B2 * 9/2011 Parks et al. ..... 166/341
8,156,953 B2 * 4/2012 Tveita ..... 137/12
8,186,441 B2 * 5/2012 Donohue et al. ..... 166/344
2009/0194290 A1 * 8/2009 Parks et al. ..... 166/339
2010/0276155 A1 * 11/2010 Niemeyer et al. ..... 166/373

OTHER PUBLICATIONS

International Search Report issued in corresponding International Application No. PCT/US2010/054525; Dated Jun. 8, 2011 (3 pages).
Written Opinion issued in corresponding International Application No. PCT/US2010/054525; Dated Jun. 8, 2011 (3 pages).

* cited by examiner

*Primary Examiner* — Matthew Buck
(74) *Attorney, Agent, or Firm* — Osha Liang LLP

(57) ABSTRACT

A hydraulic control system for operating a subsea blowout preventer includes a surface manifold configured to convey hydraulic power to the blowout preventer, a surface actuation valve hydraulically connected to subsea valves and configured to operate the blowout preventer, and a control system monitoring apparatus. The control system monitoring apparatus includes a surface manifold pressure transducer hydraulically connected to the surface manifold, an electronic readback system, and a surface control line pressure transducer hydraulically connected to the surface end of at least one control hose and the surface actuation valve. The control system monitoring apparatus is configured to read, record, and process pressure data supplied by the surface manifold and surface control line pressure transducers.

6 Claims, 3 Drawing Sheets

HYDRAULIC CONTROL SYSTEM MONITORING APPARATUS AND METHOD

CROSS-REFERENCE TO RELATED APPLICATIONS

This application claims priority, under 35 U.S.C. §119(e), to U.S. Patent Application No. 61/255,745, filed on Oct. 28, 2009, which is assigned to the present assignee and herein incorporated by reference in its entirety.

BACKGROUND

1. Field of the Disclosure

Embodiments disclosed herein relate generally to an improved hydraulic control system for actuation of subsea equipment. More specifically, embodiments disclosed herein relate to apparatus and methods for monitoring the actuation of deepwater subsea blowout preventers ("BOPs") with a hydraulic control system.

2. Background Art

Deep water drilling for oil and natural gas is conventionally conducted through a subsea blowout preventer ("BOP") stack, which may be removably attached to a wellhead proximate the seabed. One or more subsea BOPs in the stack may be closed to shut-in the wellbore if, for example, pressurized fluids enter the wellbore from a geological formation. Subsea BOP stacks may be controlled from the surface by one of a number of control system types, such as hydraulic or electro-hydraulic systems, including multiplexed ("MUX") electro-hydraulic control systems.

The earliest subsea BOP control systems were hydraulic systems, and a large number of them continue to be employed today. Hydraulic systems are generally cheaper and more robust than electro-hydraulic systems. Hydraulic systems, for example, generally have higher up-time than electro-hydraulic systems, are easier to diagnose, require fewer spare parts, and can be repaired in the field by non-specialized workers. Studies have shown that MUX electro-hydraulic BOP control systems may have an initial cost about 4 times that of a hydraulic system and over a 5-year period average about 1.8 times more downtime. Because downtime on a modern floating drilling rig can today cost on the order of $20,000 per hour, the increased downtime of MUX control systems has become a significant issue.

In deep water, however, prior-art hydraulic BOP control systems may experience delays in subsea BOP response time; for this and other reasons, electro-hydraulic control systems, especially MUX systems, may now be typically preferred for drilling in deep water, especially in waters deeper than about 5,000 feet.

Industry standards (such as those of the American Petroleum Institute ("API") prescribe maximum "closing times" for subsea BOPs, regardless of water depth; typically, annular BOPs are required to close within 60 seconds and ram BOPs are required to close within 45 seconds. Naturally, in the interests of improved safety, it is an industry goal to execute these functions as fast as practically possible.

Closing times are generally defined as the elapsed time from actuating a selected subsea BOP function at the surface (that is, on the drilling vessel) until such point that a return signal from the BOP stack has arrived back at the surface indicating that the selected BOP function has been completed. The process of actuating a subsea BOP function generally comprises 4 discrete steps: (1) sending a signal to the subsea BOP stack from the surface, (2) opening of at least one hydraulic valve on the subsea stack in response to the signal from the surface, (3) hydraulic actuation of the selected BOP function, and finally, (4) sending a signal to the surface that the BOP function has been successfully actuated.

In a prior-art hydraulic control system, indication that a selected BOP function has been successfully actuated may be provided by a pressure gauge at the surface, which is connected by way of an umbilical hose to a hydraulic manifold on the subsea stack, which powers the hydraulic actuation of the selected BOP function. When the selected BOP function is initially actuated, the pressure in the subsea hydraulic manifold drops. When the BOP function has been completely actuated, the pressure in the subsea hydraulic manifold rises back to its nominal level (typically, for example, 1500 psi). The BOP function is generally considered completed when the pressure gauge at the surface indicates that the subsea manifold pressure has returned to its nominal value.

In deep water, the pressure gauge on the surface may typically respond only very slowly to changes in the subsea manifold pressure; for example, the indicated pressure on the surface pressure gauge may return to the nominal manifold pressure between about 10 and 20 seconds after the selected BOP function has been actuated, which is a high percentage of the allowable BOP closing time.

Accordingly, there exists a need for a hydraulic control system for a deepwater subsea BOP stack that gives an accurate, more-rapid indication of the actuation of a selected BOP function, without depending on unreliable electrical signals such as are employed in electro-hydraulic control systems.

SUMMARY OF THE DISCLOSURE

In one aspect, embodiments disclosed herein relate to a hydraulic control system for operating a subsea blowout preventer, the system including a surface manifold configured to convey hydraulic power to the blowout preventer, a surface actuation valve hydraulically connected to subsea valves and configured to operate the blowout preventer, and a control system monitoring apparatus. The control system monitoring apparatus includes a surface manifold pressure transducer hydraulically connected to the surface manifold, an electronic readback system, and a surface control line pressure transducer hydraulically connected to the surface end of at least one control hose and the surface actuation valve. The control system monitoring apparatus is configured to read, record, and process pressure data supplied by the surface manifold and surface control line pressure transducers.

In other aspects, embodiments disclosed herein relate to a method of monitoring blowout preventer closing time, the method including actuating a surface actuation valve and recording a surface manifold pressure for a fixed time interval, determining a minimum value of the surface manifold pressure during the fixed interval, calculating an elapsed time between the start time of actuating the surface actuation valve and a time at which the surface manifold pressure reached a minimum value, and displaying the calculated elapsed time on the display in an electronic readback system.

Other aspects and advantages of the invention will be apparent from the following description and the appended claims.

DETAILED DESCRIPTION

Figure 1:
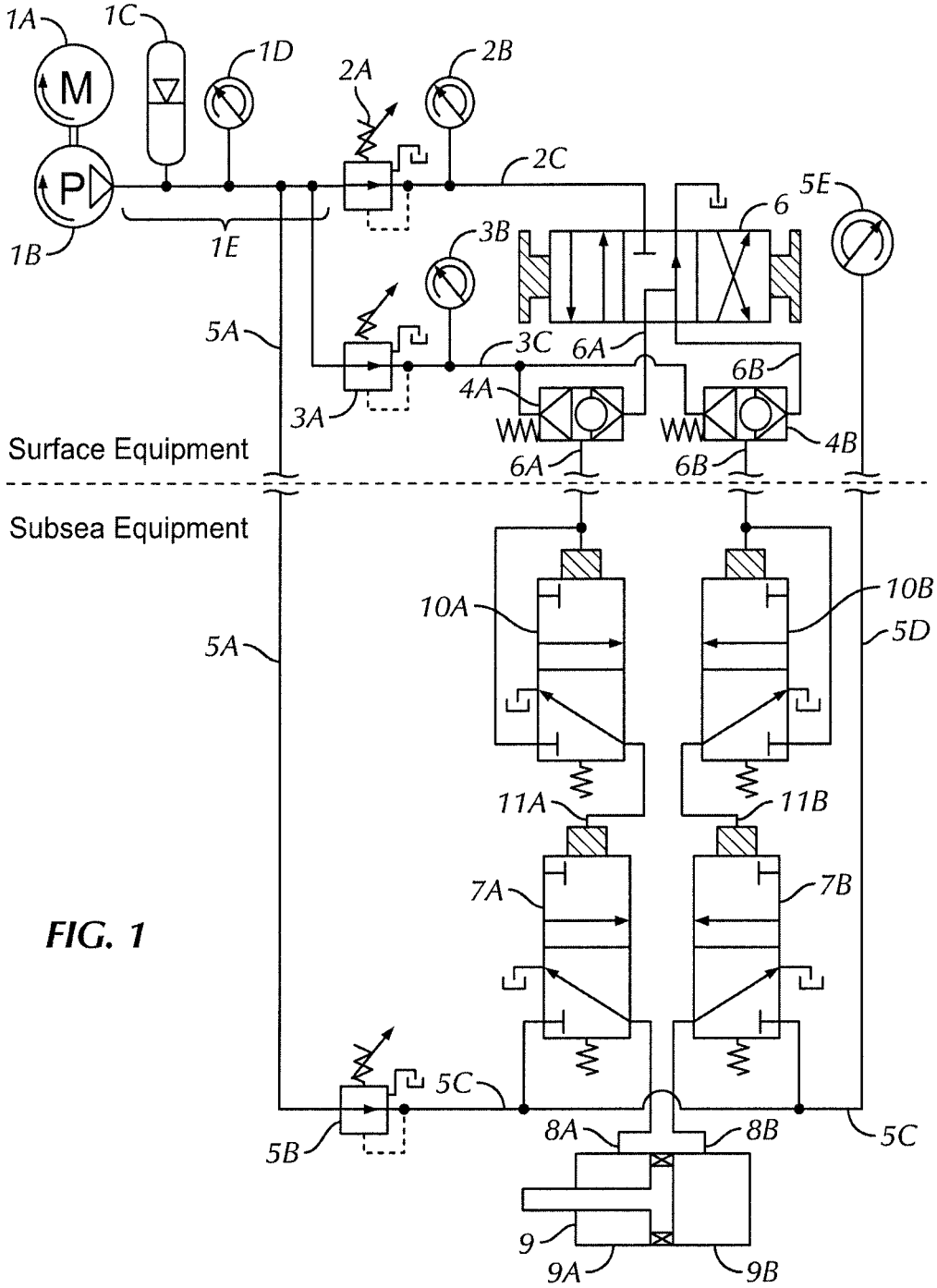
FIG. 1 is a schematic of a one channel of a prior-art hydraulic subsea blowout preventer control system.

FIG. 1 is a simplified schematic of one channel of a prior-art hydraulic control system for a subsea BOP stack. Components of the control system may be characterized as either surface equipment or subsea equipment.

Electric motor 1A drives hydraulic pump 1B, which is hydraulically connected to surface manifold 1E. Hydraulic pressure in surface manifold 1E is maintained by surface manifold accumulator 1C and measured by surface manifold pressure gauge 1D. Surface manifold 1E is also hydraulically connected to subsea hydraulic supply line 5A, which typically includes a series of interconnected steel pipes with inner diameters of 1 inch or more, attached to a drilling riser, to convey hydraulic power from the surface to the subsea BOP proximate the seabed. Surface manifold 1E may typically have a nominal regulated pressure of about 3000 psi, although other nominal regulated pressures may be possible.

Adjustable pressure regulator 2A sets the pressure in control manifold 2C, which is measured by control manifold pressure gauge 2B. Note that in some hydraulic control systems, adjustable pressure regulator 2A may not be present, in which case the pressure in control manifold 2C may be relatively coarsely regulated by a relief valve or similar device (not shown). Control manifold 2C is hydraulically connected to surface actuation valve 6, which may be a manual three-position, four-way valve, as shown, or may include one or more other valves known in the art. Control manifold 2C may typically have a nominal pressure during operation of about 3000 psi, although other nominal pressures may be possible.

Surface actuation valve 6 is hydraulically connected to subsea pilot valves 10A and 10B by control hoses 6A and 6B respectively. Subsea pilot valves 10A and 10B are hydraulically connected in turn to surface plate-mounted ("SPM") valves 7A and 7B by control hoses 11A and 11B respectively. SPM valves 7A and 7B are connected to subsea BOP 9 by hydraulic pipes 8A and 8B respectively. Note that subsea pilot valves 10A and 10B, and SPM valves 7A and 7B are depicted as non-adjustable, spring-biased valves, but they may alternately have adjustable spring bias or they may in some cases be pressure biased valves. In any case, the pressure at the bottom of control hoses 6A and 6B at which subsea pilot valves 10A and 10B are actuated, respectively, is determined by the bias settings of the subsea pilot valves.

Subsea BOP 9 further includes an opening chamber 9A and closing chamber 9B. Note that subsea BOP is depicted as a "ram" type BOP, but those skilled in the art will recognize that this control circuit could also operate other hydraulically-actuated devices, for example, an annular BOP or a gate valve. Those skilled in the art will also recognize that some subsea hydraulic systems may alternatively include a subsea pilot valve and more than one surface plate mounted ("SPM") valves for each function; for example, an hydraulic subsea control circuit for an annular BOP may include one pilot valve to open two SPM valves in order to get high flow rates, which may be required because an annular BOP typically has a very large closing chamber.

At the subsea stack, subsea hydraulic supply line 5A is connected to one or more subsea manifold pressure regulators 5B, which regulate the nominal pressure of subsea hydraulic manifold 5C at a preset pressure. (Multiple pressure regulators may be used, for example, to produce different pressures for separate manifolds for ram and annular BOPs.) The hydraulic pressure present in subsea hydraulic manifold 5C is transmitted to the surface by subsea manifold pressure hose 5D and displayed by subsea manifold pressure gauge 5E. The nominal regulated hydraulic pressure in subsea hydraulic manifold 5C is typically between 1500 and 3000 psi, although other pressures are possible.

Control hoses 6A, 6B, 11A, 11B and subsea manifold pressure hose 5D are typically high-pressure hydraulic hoses with inner diameters of about 3/16 inch which are bundled together in a "umbilical hose bundle" (or more simply, an "umbilical"), which is typically attached to the drilling riser. Surface manifold 1E is also hydraulically connected to bias pressure regulator 3A, which feeds bias pressure manifold 3C and bias pressure valves 4A and 4B attached to control hoses 6A and 6B respectively. Bias pressure regulator 3A and bias pressure valves 4A and 4B maintain the static pressure in control hoses 6A and 6B respectively at some minimum bias pressure value (typically between 250-500 psi) in order to slightly stretch the hoses such that there is less volumetric expansion of the hoses during control operations.

Note that the hydraulic control system of FIG. 1 is depicted with a bias pressure system because the test results (to be discussed later) obtained by the inventor of the current disclosure were taken from a bias pressure system. Those skilled in the art will appreciate that many subsea hydraulic control systems do not have bias pressure circuits, and furthermore, that the monitoring apparatus and methods of the current disclosure may not require a bias pressure in control hoses 6A and 6B.

To close subsea BOP 9, surface actuation valve 6 is shifted completely to the left, which has the effect of venting control hose 6A and pressurizing control hose 6B. The pressure in control hose 6B shifts subsea pilot valve 10B, pressurizing control hose 118 and which in turn shifts SPM valve 7B, which sends pressurized hydraulic fluid from subsea manifold 5C to closing chamber 9B of subsea BOP 9, which ultimately closes subsea BOP 9. To open subsea BOP 9, surface actuation valve 6 is shifted completely to the right, which has the effect of venting control hose 6B, and pressurizing control hose 6A. This in turn shifts subsea pilot valve 10A and SPM valve 7A, which sends pressurized hydraulic fluid from subsea manifold 8A to opening chamber 9B of subsea BOP 9, which ultimately opens subsea BOP 9. Note that in the central or "neutral" position, surface actuation valve 6 vents both control hoses 6A and 6B, which in turn vents the actuators of subsea pilot valves 10A and 10B and SPM valves 7A and 7B respectively.

When SPM valve 7B shifts to close subsea BOP 9, the regulated pressure in subsea manifold 5C may drop (usually by several hundred psi, up to about one thousand psi, depending in the nominal pressure in subsea manifold 5C, and the design of BOP 9 and the intervening piping), which will be displayed on subsea manifold pressure gauge 5E after a number of seconds. When subsea BOP 9 is fully closed, pressure in subsea manifold 5C will begin to rise, which will also be displayed on subsea manifold pressure gauge 5E, also after a delay of a number of seconds.

In the prior art, the "closing time" for subsea BOPs controlled by hydraulic control systems typically has been defined as the time from the shifting (or "actuation") of surface actuation valve 6 until such time as the pressure displayed on subsea manifold pressure gauge 5E has returned to the nominal pressure set by subsea manifold pressure regulator 5B for subsea manifold 5C.

Figure 2:
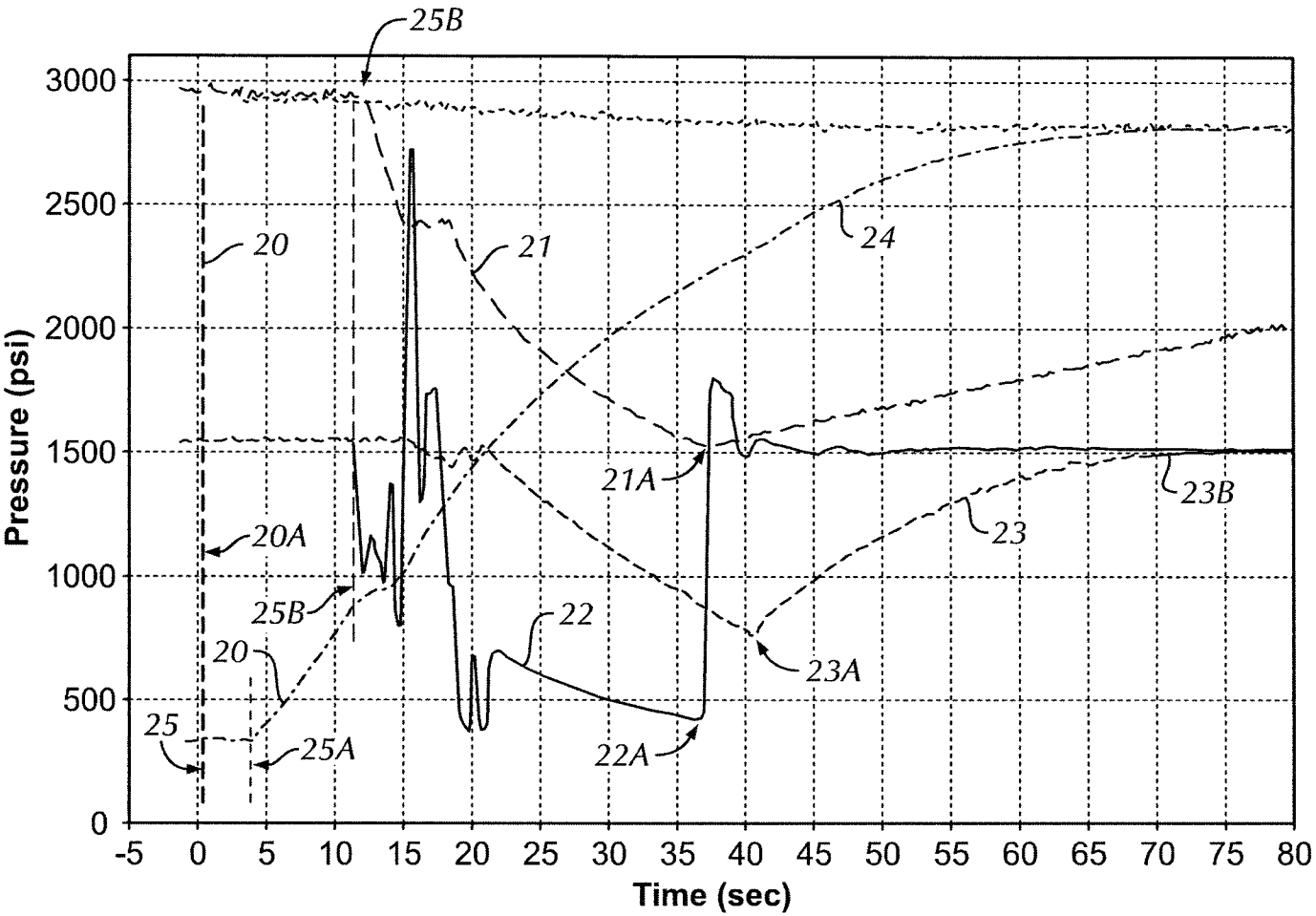
FIG. 2 is a graph of pressure versus time for various points within an annular BOP control channel in a prior-art hydraulic subsea blowout preventer control system.

Referring now to FIG. 2, a graph showing pressures taken at various points in the hydraulic circuit shown schematically in FIG. 1 during the closing of a subsea annular BOP is shown. These pressures were taken from experimental data obtained during tests performed by the inventor of the current disclosure. The graph may be interpreted as follows. Curve 20 represents the pressure at the top of control hose 6B. Curve 21 represents the pressure in surface manifold 2C. The nominal pressure (for example, at zero seconds) in surface manifold 2C is about 3000 psi. Curve 22 represents the pressure in subsea manifold 5C. Curve 23 represents the pressure shown on subsea manifold pressure gauge 5E at the surface. Curve 24 represents the pressure at the bottom of control hose 6B.

In the experimental set-up from which this data is derived, (a) the BOP is an 18¾" annular BOP, (b) control hoses 6A and 6B have inner diameters of about 3/16 inch and are each approximately 10,500 feet long, typical of a floating drilling rig in about 10,000 foot water depths, (c) control hoses 6A and 6B are spooled on a reel (which increases resistance to flow) and are not subject to external hydrostatic pressure (which allows greater volumetric expansion of the hoses than if they were deployed subsea), and (d) subsea hydraulic supply line 5A is simulated by hoses and pipes which have substantially the same flow coefficient (or "Cv") as about 10,500 feet of 1 inch inner diameter ("ID") steel pipe.

When at zero seconds (i.e., point 25), surface actuation valve 6 is shifted completely to the left (to close subsea BOP 9), the pressure at the top of the control hose 6B (i.e., curve 20) rises very quickly, while the pressure at the bottom of control hose 6B (i.e., curve 24) rises relatively slowly, due to both the relatively low flow coefficient (or Cv) of control hose 6B, and some volumetric expansion of control hose 6B when it is pressurized above its 300 psi bias pressure. After about 4 seconds, at point 25A, the pressure at the bottom of control hose 6B (i.e., curve 24) starts to slowly rise. After about 12 seconds, at point 25B, when the pressure at the bottom of control hose 6B (i.e., curve 24) reaches about 850 psi (the actuation pressure for subsea pilot valve 10B), the pressure drops quickly in subsea manifold 5C (i.e., curve 22), and drops in surface manifold 2C (i.e., curve 21) about 1 second later.

The pressure in subsea manifold 5C (curve 22) oscillates for about 8 seconds (due to hydraulic "hammer" effects induced between SPM valve 7B and BOP closing chamber 9B) before reaching a minimum at about 37 seconds at point 22A, at which point BOP 9 is fully closed and the pressure in subsea manifold 5C (i.e., curve 22) quickly rises. About one second after the BOP 9 is fully closed at point 22A, the pressure in surface manifold 2 (i.e., curve 21) reaches a minimum at about 38 seconds at point 21A. The pressure at the subsea manifold pressure gauge 5E (i.e., curve 23) begins to drop at about 15 seconds, and reaches a minimum at about 41 seconds at point 23A, or about 4 seconds after BOP 9 is fully closed at point 22A. The pressure at the subsea manifold pressure gauge 5E then begins to rise, and reaches the nominal regulated pressure of subsea manifold 5C at about 70 seconds at point 23B.

In the prior art, the BOP closing time is determined by timing (typically with a manual stop-watch) between the shifting of surface actuation valve 6 at zero seconds at point 25, until point 23B. In FIG. 2, for an annular BOP, the prior-art BOP closing time is about 70 seconds. In practice, using a manual stop-watch to time BOP closing times may actually add some additional time to the BOP closing time. As discussed, the regulatory limit for annular BOP closing time is typically 60 seconds.

Figure 3:
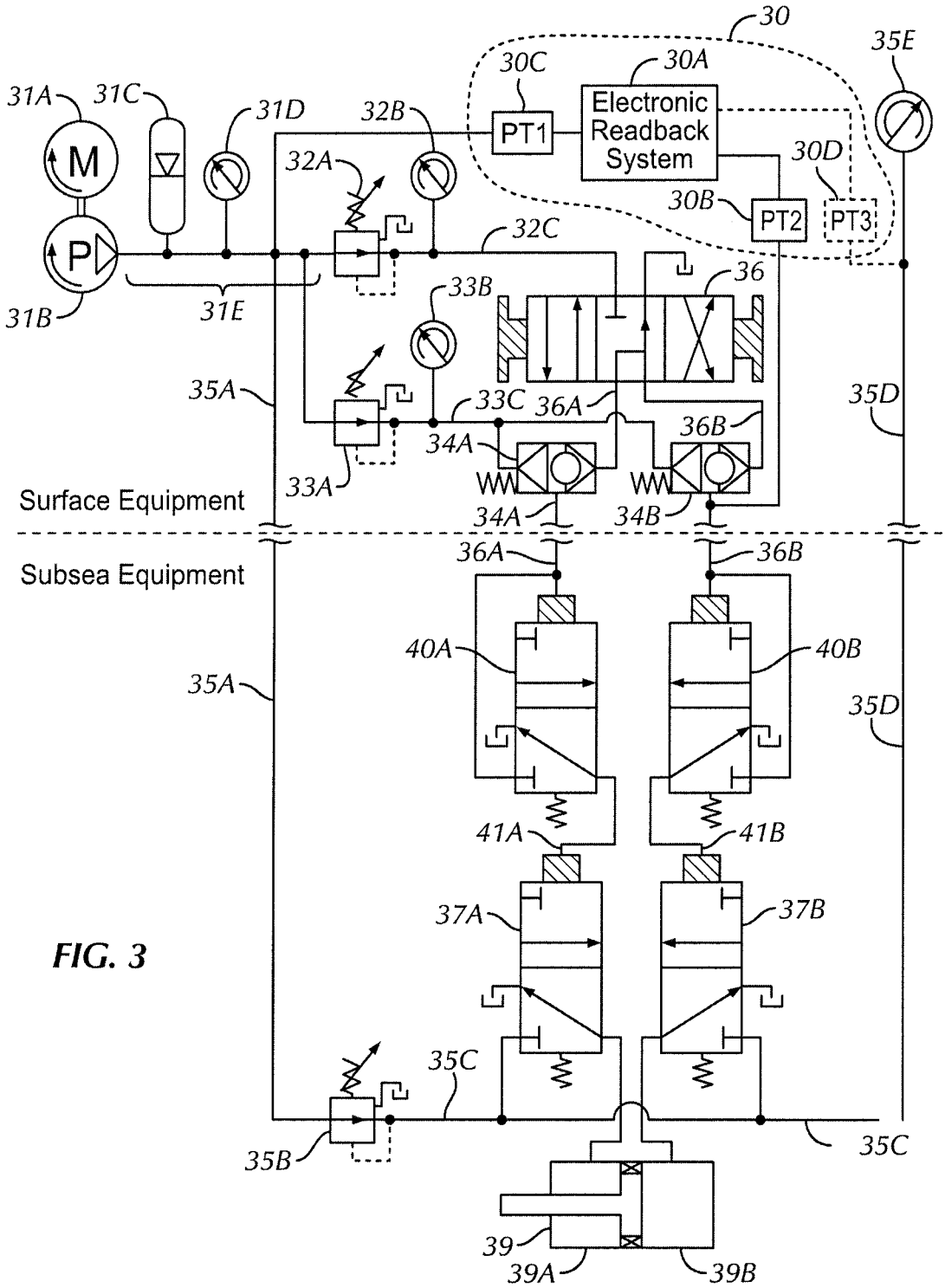
FIG. 3 is a schematic of one channel of a hydraulic subsea blowout preventer control system in accordance with embodiments of the present disclosure.

Referring now to FIG. 3, a schematic of a simplified hydraulic control system in accordance with embodiments of the present disclosure is shown. Electric motor 31A drives hydraulic pump 31B, which is hydraulically connected to surface manifold 31E. The pressure in surface manifold 31E is maintained by surface manifold accumulator 31C and measured by surface manifold pressure gauge 31D. Adjustable pressure regulator 32A sets the pressure in control manifold 32C, which is measured by control manifold pressure gauge 32B. Control manifold 32C is hydraulically connected to surface actuation valve 36.

Surface actuation valve 36 is hydraulically connected to subsea pilot valves 40A and 40B by control hoses 36A and 36B respectively. Subsea pilot valves 40A and 40B are hydraulically connected in turn to SPM valves 37A and 37B by control hoses 41A and 41B, which are then connected to subsea BOP 39 by hydraulic pipes 38A and 38B respectively. Subsea BOP 39 has opening chamber 39A and closing chamber 39B. Subsea hydraulic supply line 35A feeds one or more subsea manifold pressure regulators 35B regulating the nominal pressure of subsea hydraulic manifold 35C. Hydraulic pressure in subsea hydraulic manifold 35C is transmitted to the surface by subsea manifold pressure hose 35D and displayed by subsea manifold pressure gauge 35E located at the surface. Surface manifold 31E is also hydraulically connected to bias pressure regulator 33A, which feeds bias pressure manifold 33C and bias pressure valves 34A and 34B attached to control hoses 36A and 36B respectively.

Hydraulic control system monitoring apparatus 30 of the current disclosure includes surface manifold pressure transducer 30C, electronic readback system 30A and surface control line pressure transducer 30B. In certain embodiments, hydraulic control system monitoring apparatus 30 may also include subsea manifold readback transducer 30D. Surface manifold pressure transducer 30C is hydraulically connected to surface manifold 31E. Surface control line transducer 30B is hydraulically connected to the surface end of control hose 36B, and in most embodiments may be connected to either side of bias pressure valve 34B. Optional subsea manifold readback transducer 30D is hydraulically connected to subsea manifold pressure hose 35D, preferably proximate subsea manifold pressure gauge 35E. In certain embodiments, pressure transducers 30B, 30C and 30D will be 4-20 milliamp ("mA") pressure transducers, but alternatively other types of pressure transducers known in the art may be used, such as, for example, 0-10 volt transducers.

Electronic readback system 30A includes a means of reading, recording and processing the pressure data supplied by transducers 30B and 30C, and optionally from transducer 30D, as well as means of displaying data such as real-time pressure and calculated BOP closing times.

In certain embodiments of the present disclosure, electronic readback system 30A may include a personal computer ("PC") equipped with instrumentation interfaces to transducers 30B and 30C. In related embodiments, electronic readback system 30A may include a laptop personal computer with transducer instrument interfaces, and an interface connection to transducers 30B and 30C installed on or proximate a BOP control panel to allow the laptop PC to be attached to the transducers temporarily (as when testing a BOP stack after it has been run, or for periodic checks of the subsea stack). This may allow for the laptop PC to be used for other instrumentation and diagnostic purposes around the rig.

In certain embodiments, electronic readback system 30A may include one or more programmable logic controllers ("PLCs"), or similar devices, adapted to read, record, and process pressure data from pressure transducers 30B and 30C (and optionally pressure transducer 30D), and at least one liquid crystal display ("LCD") screen. In a related embodiment, electronic readback system 30A may include a PLC or similar device, at least one power supply, and a display device, in a suitable housing adapted for use in a hazardous environment such as on the floor of a drilling rig. Those having ordinary skill in the art will recognize that electronic readback system 30A may include devices other than personal computers or PLCs adapted to read, record, and process pressure data from the pressure transducers. For example, a dedicated circuit board, adapted to read, record and process pressure data may be used in place of a PLC or a PC.

Referring to FIGS. 2 and 3, the operation of the hydraulic BOP control system having a hydraulic control system monitoring apparatus described in embodiment disclosed herein may proceed as follows. Surface control line pressure transducer 30B monitors the pressure at the top of control line 36B (curve 20 in FIG. 2). Surface manifold pressure transducer 30C monitors pressure in surface manifold 31E (curve 21 in FIG. 2). Optional subsea manifold monitor pressure transducer 30D monitors pressure at subsea manifold pressure gauge 35E (curve 23 in FIG. 2)

When actuation valve 36 is shifted to the left to close BOP 39, pressure at the top of control hose 36B (curve 20 in FIG. 2, monitored by surface control line transducer 30B in FIG. 3) begins to rise. In certain embodiments, when the pressure in control hose 6B reaches 1000 psi at trigger point 20A, electronic readback system 30A begins to record pressure data from pressure transducers 30B and 30C. In a related embodiment, electronic readback system 30A also begins at this point to record pressure from pressure transducer 30D. In still further embodiments, pressure data recording by electronic readback system 30A is triggered by an electrical microswitch or similar device (not shown) attached to the actuation mechanism of control valve 36.

In cases where control valve 36 is typically actuated by an electrical actuation signal, for example by a solenoid, or for example by means of an electric-over-pneumatic actuator, the electrical actuation signal may be used to trigger pressure data recording by electronic readback system 30A. Using pressure transducer 30B to trigger pressure data recording has the advantages that (a) the proper operation of pressure transducer 30B may be continuously confirmed by displaying the pressure in surface manifold 31E measured by pressure transducer 30B, and (b) that pressure transducers tend to be very reliable.

However, there may be a lag of as much as one second between the actuation of control valve at zero seconds (point 25) and trigger point 20A; in some embodiments, therefore, it may be necessary to add a predetermined "lag time" to the BOP closing time calculated by hydraulic control system monitoring apparatus 30. The required "lag-time" may be determined experimentally for a particular BOP control system by measuring, by means well known in the art, the elapsed time between actuation of surface actuation valve 36 and trigger point 20A on curve 20.

Lag-time may be reduced by various means, including for example, (a) installing pressure transducer 30B hydraulically close to surface actuation valve 36, and/or (b) setting trigger point 20A at the lowest possible pressure above the nominal pressure in control hose 36B. For example, in certain embodiments of the present disclosure including a BOP control system in which control hoses 36A and 36B are pressure biased to 300 psi, trigger point 20A may be set at 450-600 psi. In other embodiments, if control hoses 36A and 36B do not have a bias pressure applied, trigger point 20A may be set to 150-300 psi.

In certain embodiments, pressure data from pressure transducers 30B and 30C (and optionally from pressure transducer 30D) may be recorded for a fixed time interval (e.g. 75-100 seconds). In a related embodiment, the fixed time interval may be longer than the required BOP closing time. In still another related embodiment, the fixed time interval may be at least 1.5 times the required BOP closing time.

In other embodiments of the present disclosure, pressure data may be recorded until the pressure measured by surface manifold pressure transducer 30C and/or optional subsea manifold pressure transducer 30D drops below a first predefined pressure value, then rises above a second predefined pressure. In a related embodiment, the first predefined pressure may be the same as the second predefined pressure. For example, recording may be stopped after the pressure measured by surface manifold pressure transducer 30C (curve 21) drops below a predefined pressure of 2000 psi (at about 23 seconds) and subsequently rises above 2000 psi (at about 78 seconds). In another example, recording may be stopped after the pressure measured by pressure transducer 30D (curve 23) drops below 1000 psi (at about 33 seconds) and subsequently rises above 1500 psi (at about 75 seconds).

In certain embodiments of the present disclosure, which is particularly appropriate for BOP control systems with electrically-actuated surface actuation valves (that is, without a lag-time at start), electronic readback circuit 30A (a) starts recording manifold pressure data upon an electrical signal that surface actuation valve 36 has been actuated, (b) stops recording pressure data after a fixed time interval, (c) retrospectively determines minimum value 21A of the pressure in surface manifold 31E (curve 21) (d) calculates the elapsed time between the start time at zero seconds (point 25) and minimum value 21A, and (e) displays the calculated elapsed time as BOP Closing Time on the display means in electronic readback system 30A. Using the data presented in FIG. 2, BOP closing time for this embodiment would be about 37 seconds (i.e. the time from zero seconds to point 21A).

In certain embodiments of the present disclosure, electronic readback circuit 30A (a) starts recording pressure data when the pressure in control hose 36B rises above a prescribed value as measured by pressure transducer 30B (e.g. 1000 psi at trigger point 20A) (b) stops recording pressure data after a fixed time interval (e.g. 75 seconds), (c) retrospectively determines minimum value (point 21A) of the pressure in surface manifold 31E (curve 21) (d) calculates the elapsed time between trigger point 20A and minimum value 21A, and (d) adds a predetermined lag-time (e.g. one second), and (e) displays the calculated elapsed time as BOP Closing Time on the display means in Electronic Readback System 30A.

Using the data presented in FIG. 2, and assuming a conservative lag time of one second, closing time for this embodiment is about 38 seconds (37 seconds from trigger point 20A to point 21A, plus one second lag time), well within the required 60 seconds closing time for an annular BOP. Note that surface manifold pressure (curve 21) always reaches a minimum (point 21A) after BOP closing chamber 9B is filled and BOP 9 is closed at point 22A, but that the time difference between points 21A and 22A is typically quite small, and is a function of water depth and the flow coefficient ("Cv") of subsea hydraulic supply line 35A.

The time difference between points 21A and 22A may be minimized by increasing the flow coefficient of hydraulic supply line 35A. In one embodiment of the present disclosure, subsea hydraulic supply line 35A is internally coated with a low friction polymer coating to increase its flow coefficient (Cv). In a related embodiment, subsea hydraulic supply line 35A has an inner diameter greater than 2 inches and is internally coated with a low-friction polymer to increase its flow coefficient (Cv).

In another embodiment of the present disclosure, BOP Control System Monitor 30 may include subsea manifold pressure transducer 30D. Electronic readback circuit 30A (a) starts recording pressure data at trigger point 20A, (b) stops recording pressure data after 75 seconds, (c) retrospectively determines minimum value 23A of the pressure in subsea manifold hose 35D (curve 23) (d) calculates the elapsed time between trigger point 20A and minimum value 23A, (e) adds a predetermined lag-time, and (f) displays the calculated elapsed time as BOP closing time on the display means in Electronic Readback System 30A. Using the data presented in FIG. 2, and assuming a conservative lag time of one second, closing time for the system is about 42 seconds (41 seconds to point 23A, plus one second lag time), well within the required 60 seconds closing time for an annular BOP.

In a related embodiment, the display means in Electronic Readback System 30A displays the real-time pressure in surface manifold 31E and/or in subsea manifold hose 35D. In another embodiment, the display means in Electronic Readback System 30A displays a graph of pressure versus time for the pressure in surface manifold 31E and/or in subsea manifold hose 35D. In another embodiment, Electronic Readback System 30A displays two BOP closing times, one based on the minimum value for curve 23 (point 23A) and one based on the minimum value for curve 21 (point 21A).

Methods related to the apparatus of the present disclosure include the steps of (a) starting to record BOP control system pressure data at a pressure trigger point, (b) stopping recording BOP control system pressure data at a stopping point, (c) retrospectively determining a minimum pressure point in a hydraulic manifold between the starting and stopping points, (d) calculating the elapsed time between a trigger point and the manifold minimum pressure point, and (e) displaying the calculated elapsed time as BOP closing time.

Another method of the present disclosure may include the steps of (a) starting to record BOP control system pressure data at a starting point determined by an electrical function actuation signal, (b) stopping recording BOP control system pressure data at a stopping point determined by a fixed time interval, (c) retrospectively determining a minimum pressure point in a hydraulic manifold between the starting and stopping points, (d) calculating the elapsed time between the starting point and the manifold minimum pressure point, and (e) displaying the calculated elapsed time as BOP closing time.

In another embodiment of the present disclosure, BOP closing time may alternatively be established by calculating the elapsed time between the starting point and a point on a manifold pressure curve which is determined using a mathematical function (such as the slope of the pressure curve) in lieu of the manifold minimum pressure point. Mathematical functions which may be applied to a manifold pressure curve for this purpose include an average rate of change of pressure (e.g. the slope of the manifold pressure curve averaged over a fixed time interval), or a percentage of the area above the manifold pressure curve (that is, the time at a certain percentage of the integral of the curve). As a general rule, however, it has been established experimentally that retrospectively determining a minimum manifold pressure point is preferred over more complicated mathematical functions.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A hydraulic control system for operating a blowout preventer, the system comprising:

a surface manifold configured to convey hydraulic power to the blowout preventer;

a surface actuation valve hydraulically connected to subsea pilot valves and configured to operate the blowout preventer;

a control system monitoring apparatus comprising:

a surface manifold pressure transducer hydraulically connected to the surface manifold;

an electronic readback system;

a surface control line pressure transducer hydraulically connected to a surface end of at least one control hose and the surface actuation valve; and one or more instrumentation interfaces to connect the electronic readback system with the surface manifold pressure transducer and the surface control line pressure transducer;

wherein the control system monitoring apparatus is configured to read, record, and process pressure data supplied by the surface manifold and surface control line pressure transducers.

2. The hydraulic control system of claim 1, wherein the electronic readback system includes a personal computer equipped with the one or more instrumentation interfaces to connect with the surface manifold pressure transducer and the surface control line pressure transducer.

3. The hydraulic control system of claim 1, wherein the electronic readback system includes at least one programmable logic controller adapted to read, record, and process pressure data from the pressure transducers.

4. The hydraulic control system of claim 1, wherein the electronic readback system includes at least one liquid crystal display screen configured to display real time pressure data.

5. The hydraulic control system of claim 1, wherein the blowout preventer is configured to have a closing time of less than 60 seconds.

6. The hydraulic control system of claim 1, wherein the control system monitoring apparatus further comprises a subsea manifold pressure transducer.

* * * * *